United States Patent [19]

Scales et al.

[11] Patent Number: 4,504,990

[45] Date of Patent: Mar. 19, 1985

[54] FIRE RESISTANT SUPPORT FOR THE HUMAN BODY

[75] Inventors: John T. Scales, Stanmore; Anthony G. Poole, Leamington Spa; David Wilson, West Bridgeford; Anthony J. Middleton, Beaconsfield, all of England

[73] Assignee: Courtaulds PLC, London, England

[21] Appl. No.: 399,331

[22] Filed: Jul. 19, 1982

[51] Int. Cl.[3] ..... A47C 27/00

[52] U.S. Cl. ..... 5/459; 5/470; 5/483

[58] Field of Search ..... 5/459, 483, 482, 497, 5/470, 471, 448, 481; 297/DIG. 5, DIG. 1, DIG. 2

[56] References Cited

U.S. PATENT DOCUMENTS

| | | | |
|---|---|---|---|
| 3,094,716 | 6/1963 | Friedman | 297/458 |
| 3,290,702 | 12/1966 | Seltzer | 5/497 |
| 3,713,697 | 1/1973 | Koepke | 297/DIG. 1 |
| 3,789,441 | 2/1974 | Weiss | 5/497 |
| 3,878,277 | 4/1975 | Velte | 297/DIG. 2 |
| 3,889,305 | 6/1975 | Goldberg | 5/459 |
| 4,092,752 | 6/1978 | Dougan | 5/459 |
| 4,136,413 | 1/1979 | Scales | 5/484 |
| 4,185,341 | 1/1980 | Scales | 5/461 |
| 4,403,356 | 9/1983 | Urai | 5/481 |

FOREIGN PATENT DOCUMENTS

| | | | |
|---|---|---|---|
| 2829873 | 1/1980 | Fed. Rep. of Germany | 5/497 |
| 1076387 | 7/1967 | United Kingdom . | |
| 1294646 | 11/1972 | United Kingdom | 5/459 |
| 1446013 | 8/1976 | United Kingdom | 5/459 |
| 1477145 | 6/1977 | United Kingdom | 5/459 |
| 1541069 | 2/1979 | United Kingdom . | |

OTHER PUBLICATIONS

U.K. Patent Application No. GB 2,012,159 filed Dec. 15, 1978, inventor Peter Edward Martin Rose, applicant Courtaulds Limited.

*Primary Examiner*—Alexander Grosz

*Attorney, Agent, or Firm*—Howson and Howson

[57] ABSTRACT

A resilient support for the human body, for example a mattress, comprises a resilient supporting block, for example of foamed polyurethane, and a fire resistant cover closely enclosing the block. At least part of the cover, which is use of the support, is intended to lie between the resilient block and a human body, is of stretch material and is able to conform to the adjacent surface of the resilient block when the support is subjected to deformation by a human body.

5 Claims, 3 Drawing Figures

FIRE RESISTANT SUPPORT FOR THE HUMAN BODY

Figure 1:
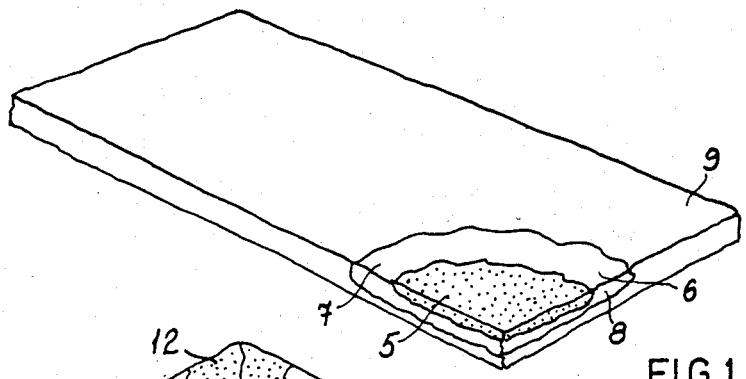

This invention relates to a support for the human body or a part thereof. Mattresses and similar supports for the human body such as cushions and pillows should desirably have good resistance to fire and this is especially the case with such supports used in public institutions, for example hospitals, where the danger arising from outbreak of fire is considerable.

Merely enclosing a resilient supporting block such as a block of foam in a cover of fire resistant woven cotton fabric is likely to produce a support which is uncomfortable in use and the present invention is the result of development work carried out to discover a support construction which will provide a sufficiently high degree of comfort and a satisfactorily high resistance to fire.

According to the invention a resilient support for the human body, or a part of the human body, comprises a resilient block closely enclosed by a fire resistant cover rendering the support fire resistant, wherein at least that part of the cover intended to lie between the resilient block and a human being is of stretch material able to conform to the adjacent surface of the block when the support is subjected, in use, to deformation by a human being.

The resilient support with which this specification is concerned may be a mattress or a part of a mattress, such as a "biscuit" used to make up a bed, for example in a caravan, together with other similar biscuits. It may also, for example, be a cushion constituting part of the base or back or side of a chair or settee, or a scatter cushion or pillow.

In order to conform to the surface of the support, when the support is supporting a human being, the stretch cover must stretch sufficiently so as not to bridge depressions created in the support but must adapt itself to follow closely the contour of ridges and valleys produced in the support. The fabric must recover sufficiently after extension so as to avoid forming creases or rucks after the support has returned to its undistorted state.

When the resilient support of the invention is in the form of a mattress, the resilient nature of the cover ensures that it closely follows deformations produced in the upper surface of the mattress by the user's body, thereby preventing the localised increase in pressure on the user's body which can occur when less resilient covers are used on a mattress. In the case of long term use of a mattress in accordance with the invention, for example by an invalid, the resilient nature of the cover has been found to reduce the incidence of bed sores.

Preferably the fire resistance of a cover used in the support, or a fabric used in making the cover is such that the cover or fabric, after one wash in water at 71° C., will fulfill the requirements (omitting the cleansing procedure) of Type C performance when tested according to Part 2 of British Standard No. 5867.

Preferably the stretch cover is made from a material which has an extension of at least 20 percent in the width direction and at least 10 percent in the length direction measured on a Fryma Extensiometer according to British Standard No. 4294 using a load of 3 kg. Advantageously, the stretch cover used in a support according to the invention has an extension of not less than 30 percent in the width direction and not less than 15 percent in the length direction when tested under the conditions just mentioned. The width extension may be 35 percent or above. The fabric need not contain elastomeric yarn.

Preferably the support will score a "pass" in the flammability test set out below comprising a modification of PSA Fire Retardant Specification No. 4 (as amended April 1978) of the Steering Committee on Flammability of the Department of the Environment, when using ignition sources also described below which are ignition sources (4) and (0) as set out in PSA Fire Retardant Specification No. 10 dated September 1976 and amended April 1978. The flammability tests may be carried out on a test piece smaller than the normal article but it is believed that if a small test piece fulfils a test set out below, then the corresponding full size article is likely to be sufficiently flame resistant.

The stretch cover may be made from a fabric incorporating a flat polyamide yarn and a cellulosic yarn, the fabric being weft-knitted in a single jersey structure so as to incorporate the cellulosic yarn in the form of pile loops. The fabric is treated to render the cellulosic yarn, and thus the whole fabric, fire resistant. Preferably, the cellulosic yarn constitutes at least 75 percent and advantageously 80 percent or more by weight of the fabric and has a weight, after treatment with flame retardant, of at least 250 g/m$^2$.

The enclosing cover may comprise a sheet to lie adjacent an upper supporting surface of a resilient block, a sheet to lie adjacent an under surface of the resilient block and a side piece seamed to the upper and under sheets and having its ends seamed together, for example at a corner of the resilient block. Alternatively, the enclosing cover may comprise pieces of sheet material adhered to all the surfaces of the resilient block. A further possibility is that the cover may comprise a piece of sheet material adhered to an under surface of the resilient block and a further piece of sheet material covering an upper surface and side surfaces of the resilient block. For example, such a further piece of sheet material may comprise an upper sheet with a further sheet attached to and depending from its edges to cover the side surfaces of a resilient block, the lower edge of the further sheet having a length of elastic material attached to it so that on fitting said further piece of sheet material to a correspondingly shaped resilient block of suitable size, the lower edge of said further sheet will be drawn in by the elastic material beneath the under surface of the resilient block so as to hold the further piece of sheet material on the resilient block like a fitted sheet on a mattress.

Figure 2:
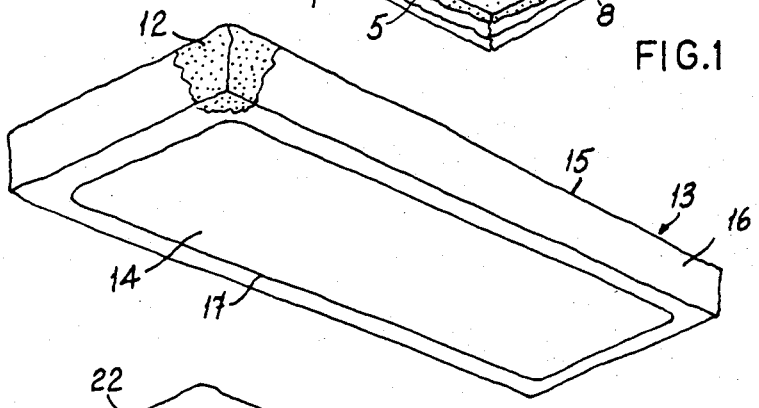
Figure 3:
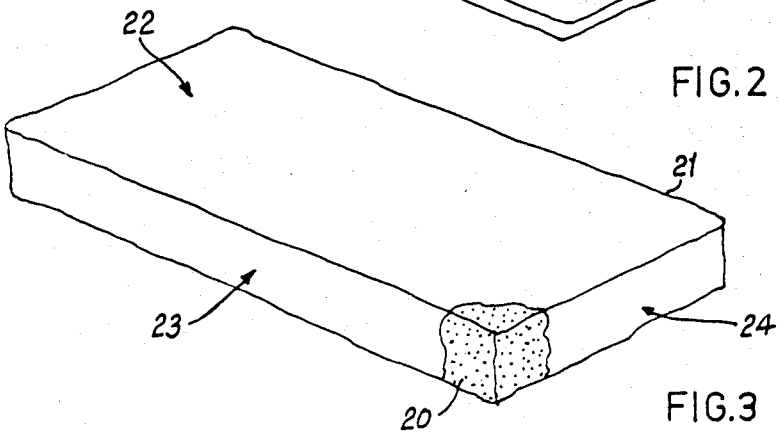

The invention will be further described, by way of example, with reference to the accompanying drawings in which:

FIG. 1 is a schematic perspective view of a mattress according to the invention, with parts of one corner broken away to reveal the underlying structure, and FIGS. 2 and 3 are similar views of other mattresses according to the invention.

The mattress according to the invention shown in FIG. 1 comprises a block 5 of foamed synthetic polymeric material, in this case foamed polyurethane.

The block 5 is closely enclosed by a fire resistant stretch cover 6 made from an upper sheet 7, corresponding in shape and size to a plan of the mattress, a similar lower sheet, and a side piece 8 seamed to the upper and lower sheets and its ends seamed together at one corner of the mattress.

Enclosing the block 5 and the cover 6 is a further cover 9 made from a polyurethane-coated, warp-knitted, nylon fabric. The cover 9 is waterproof, the polyurethane coating is on the outside, and the seam construction of the cover 9 is the same as that of the cover 6.

In order to facilitate replacement of the covers 6 and 9 when they are in need of cleaning or repair, each of these covers may be provided with an opening, preferably along a long side of the mattress, which is closable by a quick release fastener, for example a sliding clasp fastener.

The fabric from which the cover 6 is made is a plain weft-knitted terry fabric. The fabric is knitted on a circular knitting machine in a construction providing a ground structure of a flat nylon (polyamide) yarn and pile loops of a cellulosic yarn. The pile loops of the pile fabric are present on one surface only of the fabric which is the inside surface of the cover 6. The pile loops are thus in contact with the polyurethane foam of the block 5 and the result is a reduced tendency of the cover 6 to move relatively to the block 5.

The cellulosic yarn in the fabric of the cover 6 is a spun yarn comprising 67 percent by weight of cotton and 33 percent by weight of viscose. The fabric comprises 23 percent by weight of the nylon ground yarn and 77 percent by weight of the cellulosic pile yarn and is rendered flame resistant by treatment with "Proban 210" marketed by Albright and Wilson Limited. ("Proban" is a trade name.) The flame resistant treatment and the fabric must be such that the treated fabric will, after one wash in water at 71° C., fulfill the requirements (omitting the cleansing procedure) of Type C performance when tested according to Part 2 of British Standard No. 5867. An alternative flame resistant treatment which will provide the necessary degree of resistance is "Pyrovatex CP" of the Ciba Geigy Group ("Pyrovatex" is a trade name). Both the treatments mentioned are based on compounds containing nitrogen and phosphorus.

The mattress just described, comprising a foam block, a barrier fabric (cover 6) and an outer, waterproof cover 9, registers a pass in the flammability test mentioned above and described below and based on that set out in PSA Fire Retardant Specification No. 4 (as amended April 1978) of the Steering Committee on Flammability of the Department of the Environment, when using ignition source (4) or (0) as set out in PSA Fire Retardant Specification No. 10 (also as amended April 1978).

A preferred example of the fabric constituting the cover 6 is made on a 20 gg Camber Velnit Plus circular knitting machine using a sinker height of 2.9 mm. The fabric is knitted from a ground yarn which is 110 decitex flat nylon 66 and a pile yarn which is 1/28s cc comprising a blend of $\frac{2}{3}$ cotton and $\frac{1}{3}$ viscose by weight. The course length used for the nylon yarn was 711 cm and the course length for the pile yarn was 1740 cm. The weight of the fabric after treatment with the flame retardant is in excess of 250 g/m$^2$ and it has an extension in the width (course) direction in excess of 30 percent and an extension in the length (wale) direction in excess of 10 percent, measured on a Fryma Extensiometer according to British Standard No 4294 using a load of 3 kg. This extensibility allows the cover to stretch so as to be able to conform to the mattress surface when the mattress is subjected, in use, to deformation by a human being lying on it and turning and moving.

FIG. 2 shows a further mattress according to the invention comprising a resilient block 12 of foamed polyurethane closely enclosed by a composite cover 13. The cover 13 is made up of a piece of sheet material constituted by a woven cotton fabric 14, adhered to the surface of the block 12 intended to be the under surface in use, and a further piece of sheet material 15 constituted by a plain weft-knitted fabric like that of the cover 6 in the mattress of FIG. 1. The sheet material 15 is in two parts, a part conforming in size and shape to the upper surface of the resilient block 12 and a part 16 covering the sides and part of the under surface of the resilient block 12. The part 16 of the sheet material 15 is attached to and depends from the edge of the part of the sheet material 15 and has attached to its edge 17 a length of elastic material so that the edge 17 is drawn beneath the under surface of the resilient block 12.

The woven cotton fabric 14 of the mattress of FIG. 2 is rendered flame resistant by treatment with "Proban 210" marketed by Albright and Wilson Limited and satisfies the same test according to Part 2 of British Standard No. 5867 as described above in relation to the fabric of the cover 6 of the mattress of FIG. 1. The adhesive used to adhere the fabric 14 to the block 12 should have fire resistant properties such as not to render the performance of the mattress in the flammability tests to be described below unsatisfactory.

In place of the woven cotton fabric 14, a piece of fabric made from polyester yarn may be used provided that the resulting mattress will still satisfy at least one of the flammability tests to be described below.

The fabric constituting the further piece of sheet material 15 is treated with "Proban 210" so as to satisfy the same flammability test as described above in relation to the fabric of the cover 6 of the mattress of FIG. 1.

The mattress shown in FIG. 3 comprises a resilient block 20 of foamed polyurethane enclosed by a cover made up of six pieces of fabric 21 adhesively secured respectively to the top and bottom 22, the two longitudinal sides 23 and the two end sides 24 of the resilient block 20. The fabric 21 is of the same construction and has been treated in the same way as the fabric from which the cover 6 of FIG. 1 is made.

One of the flammability tests set out below is based on ignition source (4) of the DOE/PSA Fire Retardant Specification No. 10 (SCOFF Paper No. 4 amended April 1978). Ignition source (4) is a wood crib made from ten sticks of the softwood pinus silvestris 6.5 ($\pm$0.5)$\times$6.5$\times$40 ($\pm$1) mm long conditioned as set out below. The sticks are to be stacked five layers high, two sticks in each layer parallel to one another and at right angles to the sticks in the adjacent layer or layers. The sticks are glued at the ends of the sticks with PVA adhesive, the sticks in each layer being placed as far away from each other as possible but without overhang to form a square section crib. The total mass of the sticks should be 8.5$\pm$0.5 g. A small amount of wood wool (0.75$\pm$0.25 g) should be pushed loosely into the centre of the stick arrangement and when required is ignited from the top with a match.

Ignition source (0) of the DOE/PSA Fire Retardant Specificaton No. 10 (SCOFF Paper No. 4 amended April 1978) is a cigarette, characterizing a smouldering situation.

The cigarette to be used in the test is an untipped cigarette having a length of approximately 68.5 mm, a diameter of approximately 8.0 mm and a weight of 1.0 g nominal, with a smouldering rate of 14.0±2 min/50 mm when tested as follows.

To test the cigarette it is first conditioned for a minimum period of 16 hours in an atmosphere having a temperature of 20°±2° C. and a relative humidity of 65±5 percent and is tested within 1 hour after removal from the conditioning area. The cigarette is marked at distances of 5 mm and 55 mm from the end to be lit and is then lit. Air is drawn through the cigarette until the tip glows brightly and it is then impaled horizontally in draught-free air on a horizontal wire spike inserted to a distance of not more than 13 mm into the unlit end. The time taken for the cigarette to smoulder from the 5 mm to the 55 mm mark is noted and should be within the rate set out above.

The flammability test referred to above and comprising a modification of the DOE/PSA Fire Retardant Specification No. 4 entitled "Composite Upholstery Ignition Standard (Seating and Bedding)" first issued September 1976 and amended April 1978 is intended to provide a means of assessing (inter alia) the likely ignition behaviour of composite bedding components, comprising the mattress cover with a fire barrier interlining, plus the supporting components which may be flexible foam, other soft infills such as hair, kapok or cotton wadding etc., spring supports, webbing, torsion springs, platform supports etc., or any combination of them.

For the present purposes, samples are tested against the ignition sources (4) and (0) from PSA/FR Specification No. 10 mentioned above.

Articles satisfying the tests are adequately flame resistant for use in hospitals. The tests are carried out on a sample comprising a resilient support block measuring 45 cm×45 cm and having a thickness equal to the thickness of an equivalent support block intended for normal use. In the case of a mattress, the test block is smaller than the full sized article but in the case of a cushion or pillow or a mattress biscuit constituting part of a full sized mattress, the test block is of the same order of size as the normal article.

The sample to be tested will normally be tested in condition of normal use, fitted with any covers normally applied. The basis of the test method is to ignite the sample under test using a cigarette (ignition source (0)) and a wooden crib (ignition source (4)) and then to measure the distance from the ignition source over which damage occurs.

The materials used to make up the sample under test are first conditioned in an atmosphere having a temperature of 15° C. to 25° C. and a relative humidity of 55 percent to 65 percent for a minimum of 24 hours. The test is commenced within one hour of removal from the conditioned atmosphere.

The area where the test is conducted is maintained at a temperature of 15° C. to 30° C. and at a relative humidity of 20 percent to 65 percent and must be draught free.

The sample is placed on a flat surface on a rig comprising a horizontal square frame made from 25×25 mm steel angle section, the side of the square being 450 mm long. The frame has a leg of the same angle section at each corner and each leg is 390 mm long. The centre of the square frame is filled with a piece of woven wire mesh having 2 mesh wires per 25.4 mm. Each wire has a round cross-section of 1.626 mm diameter, giving approximately 76 percent of open area. The sample is placed squarely on the rig in its normal horizontal position in still air with no draughts. In the case of a mattress the sample may be covered with a sheet or sheets to reproduce a full size bed arrangement which the test sample is intended to represent.

Ignition source (0), a cigaretts, is placed, after being lit and with the tip glowing brightly, on the upper surface of the sample parallel to and 10 cm from one edge of the sample with each end of the cigarette more than 10 cm from the adjacent edge of the mattress which extends at right angles to the said one edge. The cigarette is allowed to burn its entire length and the sample is observed. A record is made as to whether sustained combustion of any component of the assembly occurs after the cigarette has ceased to burn and the duration of this combustion. The test with ignition source (0) is repeated twice making a total of three tests.

Ignition source (4), a wooden crib, is placed in the centre of the sample on its upper surface and is ignited.

The maximum distance from the centre of the sample at which damage has occurred to any component of the sample or covering is recorded ten minutes after igniting the crib. A record is made of whether flaming of any component or cover continues for more than ten minutes after lighting the crib and of the height of the flame at that time.

The same sample as used for the tests with ignition source (0) may be used for the test with ignition source (4) provided that no sustained combustion is initiated by ignition source (0). A period of 15 minutes should be allowed to lapse between the completion of the tests with ignition source (0) and the ignition of ignition source (4) on the same sample.

For the sample to pass the test, the results shall be as follows:

In the case of ignition source (0), two minutes after the ignition source has stopped burning no combustion of any component or cover shall continue.

In the case of ignition source (4), there shall be no damage to any component or cover more than 15 cm from the centre of the sample within 10 minutes of ignition of the source and no flames higher than 5 cm shall be present 10 minutes after ignition of the source.

The tests should, as a safety precaution, be carried out in a purpose built fireproof enclosure with adequate means for ventilating following the test.

What is claimed is:

1. A resilient support for the human body comprising,
(a) a resilient supporting block,
(b) cover means closely enclosing said block,
(c) wherein said cover means are fire resistant,
(d) at least that part of said cover means intended to lie between the block and a human being being of stretch material,
(e) said stretch material having a recoverable extension of at least 20 percent in the width direction and at least 10 percent in the length direction measured on a Fryma Extensiometer according to British Standard No. 4294 using a load of 3 kg, whereby said stretch material is able to conform to the adjacent surface of the block when the support is subjected to deformation by a human being and recover sufficiently after extension so as to avoid forming creases or rucks after the block has returned to its undeformed state, said stretch material comprising,
(f) at least 75 percent by weight of cellulosic yarn based on the weight of the fabric and wherein,
(g) the fabric has a weight, after treatment with flame retardant, of at least 250 g/m$^2$.

2. A support as claimed in claim 1, wherein said fire resistant cover is made of fabric such that after one wash in water at 71° C. the fabric fulfils the requirements (omitting the cleansing procedure) of Type C performance when tested according to Part 2 of British Standard No. 5867.

3. A support as claimed in caim 1, wherein said material has a recoverable extension of not less than 30 percent in the width direction and not less than 15 percent in the length direction.

4. A support as claimed in claim 1, wherein said cover comprises a piece of sheet material adhered to an undersurface of the resilient block and a further piece of material covering at least an upper surface and side surfaces of the resilient block.

5. A support as claimed in claim 1, wherein said cellulosic yarn is formed into pile loops on the surface of said fabric adjacent the resilient block.

* * * * *